US007776133B2

(12) United States Patent
Nakagawa et al.

(10) Patent No.: US 7,776,133 B2
(45) Date of Patent: Aug. 17, 2010

(54) METHOD OF OPERATING NON-FERROUS SMELTING PLANT

(75) Inventors: Kenta Nakagawa, Oita (JP); Yutaka Yasuda, Tokyo (JP); Yoshiaki Suzuki, Okayama (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 227 days.

(21) Appl. No.: 12/216,176

(22) Filed: Jun. 30, 2008

(65) Prior Publication Data

US 2009/0064820 A1 Mar. 12, 2009

(30) Foreign Application Priority Data

Sep. 12, 2007 (JP) ..... 2007-236730

(51) Int. Cl.
*C22B 15/04* (2006.01)
*C22B 15/06* (2006.01)

(52) U.S. Cl. ..... 75/585; 75/641; 75/643; 241/23

(58) Field of Classification Search ..... 75/585, 75/641, 643; 241/23
See application file for complete search history.

(56) References Cited

U.S. PATENT DOCUMENTS 4,373,451 A * 2/1983 Gardner et al. ..... 110/101 CC
4,470,845 A * 9/1984 Yannopoulos ..... 75/629
2004/0144874 A1* 7/2004 Moskowitz ..... 241/30

FOREIGN PATENT DOCUMENTS

JP 5-15805 A 1/1993
JP 2002-172339 A 6/2002
JP 2006-110474 A 4/2006

OTHER PUBLICATIONS

"Copper Smelting in Kosaka Smelter", "Shigen to Sozai", Journal of the Mining and Materials Processing Institute of Japan, 1993, vol. 109 No. 12, "Special Edition of Non-ferrous Smelting", p. 938, Fig. 1.
"Shigen to Sozai", Journal of the Mining and Materials Processing Institute of Japan, 1993, vol. 109, No. 12, "Special Edition of Non-Ferrous Smelting" supra, p. 961, Fig. 4.
"High Intensive Operation and Increase in Productivity in Saganoseki Smelter by using a Single Flash Furnace", Shigen to Sozai, Journal of the Mining and Materials Processing Institute of Japan, 1998, vol. 114, No. 7., pp. 447-454.

* cited by examiner

*Primary Examiner*—George Wyszomierski
*Assistant Examiner*—Tima M McGuthry-Banks
(74) *Attorney, Agent, or Firm*—Birch, Stewart, Kolasch & Birch, LLP

(57) ABSTRACT

In the operation, a flux mainly composed of silica ore and a non-ferrous metal-ore raw-material are charged into a smelting furnace via a conveying system. In order to increase the production amount of the metal, the flux is conveyed and treated through a first system, in which the flux is crushed in a ball mill and dried in the bail mill, and the crushed and dried flux is conveyed directly before the smelting furnace. The non-ferrous metal ore is treated and conveyed through a second system, in which it is dried with a drier and then conveyed directly before the smelting furnace. In the drier of copper concentrate, the flux is not dried at all.

11 Claims, 6 Drawing Sheets

METHOD OF OPERATING NON-FERROUS SMELTING PLANT

BACKGROUND OF THE INVENTION

1. Field of Invention

The present invention relates to a method for operating a non-ferrous smelting plant, and more particularly to a method for increasing the production amount of non-ferrous metals. In a non-ferrous smelting plant, the raw material, such as copper or nickel sulfide ores or their concentrates, together with a flux mainly composed of silica ore, are introduced into a smelting furnace, such as a flash furnace or a reverberatory furnace. The present invention is hereinafter described mainly with reference to copper smelting by means of a flash furnace.

2. Description of Related Art

The silica ore, which is fed to a copper smelting furnace, such as a flash furnace or a reverberatory furnace, supplies $SiO_2$ that reacts with Fe in the copper ores. Precious metals such as gold and silver, contained in small amounts in the silica ore, are also recovered in the copper smelting process. The silica ore is conveyed from a mine to a smelting plant and is stored outdoors, and is then crushed in a lateral type ball mill, which is appropriate for continuous operation. Since the silica ore is a flux that smoothly advances the slagging reactions in the reaction tower of a flash furnace during the smelting of copper, it is crushed to a particle size virtually as fine as that of the copper concentrate. The particle size of the crushed silica ore is usually approximately 100 μm on average. The amount of the flux is approximately 10% relative to the copper ore but this percentage increases as a grade of the copper ore is lowered.

Meanwhile, the copper ore as a raw material has been crushed and dressed at the mine and is then conveyed to a smelting plant. The resultant concentrate is subsequently dried with a drier and is then charged into the flash furnace. Incidentally, in the past, there was a step in which flux and powdered copper ore were sintered in the copper smelting, but this is no longer done.

The flux mentioned above is dried together with the copper concentrate and is then charged into the flash furnace. This method is an ordinary one, and is described in Japanese Patent No. 3,307,444 (FIG. 1), "Shigen to Sozai" (JOURNAL OF THE MINING AND MATERIALS PROCESSING INSTITUTE OF JAPAN), 1993, Vol., 109, No. 12, "Special Edition of Non-ferrous Smelting", "Copper Smelting In Kosaka Smelter" page 938, FIG. 1. In addition, the copper concentrate and flux are dried together also in the MI method (c.f. Special Edition of Non-Ferrous Smelting" supra, page 961, FIG. 4. In all of the smelting methods described above, the copper-ore raw material and the flux are dried and then conveyed together in the identical system.

Shigen to Sozai (JOURNAL OF THE MINING AND MATERIALS PROCESSING INSTITUTE OF JAPAN) 1998, Vol. 114, No. 7., pages 447-454, "High Intensive Operation and Increase in Productivity in Saganoseki Smelter by using a Single Flash Furnace", discloses a method for increasing the capacity of a drier to treat the copper ore and the flux. The production amount of copper is increased by reconstructing several apparatuses as follows. Diameter of a pipe for feeding air into a rotary drier is increased. A hot-air generating furnace is changed from a lateral type to a vertical type. Heavy oil is combusted in a larger amount. The capacity of an exhaust gas fan is increased. A dust collector is reconstructed.

A ball mill is described in Japanese Unexamined Patent Publications (kokai) No. 2002-172339, No. 2006-110474, and No. Hei 5-15805. However, these publications are not related to crushing of non-ferrous metal ores or flux.

Generally speaking, in order to dry and convey the ore and the flux at a higher speed, a gas-stream drying apparatus and a belt conveyor must be completely redesigned and rebuilt, which requires a large investment cost. To redesign a drier, since such factors as the solid/gas ratio and dust collecting capacity must be taken into consideration comprehensively, a number of difficulties arise in the drier reconstruction. As a usual practice, instead of reconstructing the existing drier, an additional drying and conveying system of the copper concentrate has been constructed in parallel to an existing similar drying and conveying system. In this case, operation of a non-ferrous smelting plant is carried out by two parallel systems, and hence, the drying and conveying capacity is increased. Since the additional system is constructed while an existing system is being operated, interruption of drying and conveyance of copper concentrate is minimum. However, the two parallel drying and conveying systems are detrimental in view of complicacy, ineffective operation, excessive capacity, and large investment cost.

Meanwhile, crushing of the silica ore, which serves as a flux, can be said as a factor that impedes non-ferrous smelting as described below. Fundamental heat for drying the silica ore is the crushing heat generated by the crushing action of the ball mill. When the water content of the silica ore fed to the ball mill increases, that heat is not sufficient for drying it. Dew formation, therefore, occurs in the ball mill, so that the materials contained in the ball mill, such as silica ore particles, flux powder, balls and the like, adhere to the inner wall of the pot and become bonded thereto. The water content of the silica ore and the like cannot, therefore, be lowered. The crushing efficiency is also lowered. In the worst case, crushing is difficult to continue.

Since the drying performance of a conventional ball mill of the silica ore is unsatisfactory, the usual practice has been to mix the crushed silica ore with the copper concentrate and is then dry them again in a drier together. The dried copper concentrate and the twice dried silica ore are conveyed to and charged into a flash furnace. The water content of the silica ore is a factor that limits the amount of silica ore that can be fed. In order to increase the production amount of copper and also to cope with change of grade of a copper concentrate, an increased amount of silica ore must be employed. It can, therefore be said that the drying capacity of a ball mill had not been fully utilized heretofore, thus limiting the amount of the silica ore that could be treated in a ball mill.

A countermeasure against the circumstances described hereinabove is that a smelter of non-ferrous metal would buy previously crushed silica ore. However, 15% or more of water is added to the crushed silica ore, so as to prevent the dust generation during conveyance. As a result, when the crushed silica ore is charged into a drier of copper-concentrate, the drying load of the drier is increased corresponding to the water content of the silica ore, thus limiting the amount of copper concentrate that can be treated.

SUMMARY OF THE INVENTION

It is, therefore, an object of the present invention to provide a method for operating a non-ferrous smelting plant, in which the amount of copper concentrate to be treated can be increased by a measure which does not essentially increase the number of conveying and treating apparatuses in a smelting plant.

The present inventors conceived a concept that: the crushing and drying of silica ore should undergo simultaneously; and, a new crushing, drying and conveying system of the silica ore is installed in parallel to an existing system for drying and conveying the copper concentrate. Meanwhile, in the prior art these lines are arranged in series as described above. Accordingly, the present operation method proposes to convey, directly before a smelting furnace, crushed and dried silica ore in a special system separated from the system for conveying the copper concentrate. Unlike the present invention, in the prior art, the silica ore and the copper concentrate are conveyed in the identical system. According to the present invention, since a drier of the copper concentrate is used exclusively for drying it, the weight equivalent to that of the silica ore, which is conventionally dried in the drier, can be used for drying the copper concentrate. The amount of the copper concentrate that can be treated, is therefore increased.

The present invention provides the following methods.

(1) A method for operating a non-ferrous metal smelting plant, wherein a flux mainly composed of silica ore and a non-ferrous metal-ore raw-material are charged into a smelting furnace via a conveying system, characterized in that said flux is conveyed and treated through a first system, in which the flux is crushed in a ball mill and dried in the ball mill while hot air is blown into the ball mill, and the crushed and dried flux is conveyed directly before the smelting furnace, while the non-ferrous metal-ore raw-material is treated and conveyed via a second system, in which the non-ferrous metal-ore raw material is dried with a drier and then conveyed directly before the smelting furnace, and subsequently the dried flux and the non-ferrous metal-ore raw-material are charged into the smelting furnace, thereby increasing the crushing amount of flux in the first system by means of hot air drying, and limiting the drying in the second system only to the non-ferrous metal-ore raw-material, and hence increasing the treating amount in the smelting furnace.

(2) A method according to (1), characterized in that the first system comprises subsequent to the ball mill, an ore bin of the flux and a measuring equipment, and the second system comprises preceding the drier, an ore bin of the non-ferrous metal-ore raw-material and a measuring equipment, and further the flux and the non-ferrous metal-ore raw-material are mixed together at a predetermined proportion directly before the smelting furnace.

(3) A method according to (1) or (2), wherein fuel is treated, conveyed and dried in the second system.

(4) A method according to any one of (1) through (3), characterized in that the flux is fed into a lateral-type ball mill from an aperture formed through a wall across the rotary axis of the pot of the ball mill, hot air is blown through the aperture into the pot of the ball mill during rotation of the ball mill, and the crushed and dried flux is withdrawn through an aperture formed through the other wall opposite the feeding aperture.

(5) A method according to (4), characterized in that a tubular body is mounted in the aperture for blowing the hot air or the aperture for withdrawing the crushed and dried flux in such a manner that the pot of the ball mill rotates about the tubular body, and a chute for feeding the flux protrudes through the tubular body to orient the front end of the chute toward the interior of the pot, and further the hot air is blown through the tubular body.

(6) A method according to (4) or (5), characterized in that the hot air in the pot of the ball mill is drawn by means of a suction fan provided at the ore withdrawal side of the lateral type ball mill.

(7) A method according to (5) or (6), characterized in that a boosting fan mounted on the feeding side of the lateral type ball mill urges the hot air into the pot of a ball mill.

(8) A method according to any one of (1) through (7), wherein the non-ferrous metal smelting plant is operated to produce sulfuric acid through the contact process by means of converting $SO_2$ to $SO_3$ by a converter of the plant for producing sulfuric acid through contact process, and guiding the $SO_3$ via a heat exchanger to an absorbing tower, characterized in that: a bypassing gas passage, which is branched from a gas passage from the heat exchanger to the absorbing tower, is provided in parallel to the latter gas passage; a flow-control valve and an $SO_3$ cooler are mounted on the by passing gas passage; the gas flow through the bypassing passage is controlled to attain temperature of 160° C. or higher in the $SO_3$ cooler; and, the gas recovered in the $SO_3$ cooler is utilized as the hot air for drying the silica ore.

(9) A method according to (8), characterized in that the boosting fan sends the gas recovered in the $SO_3$ cooler into the ball mill.

(10) A method according to (9), wherein the boosting fan of hot air is provided with a means for controlling its number of revolutions, and further the bypassing gas passage comprises a controllable damper for introducing cold air into the ball mill located upstream of the boosting fan, thereby controlling the rotary number of the boosting fan and the opening degree of the dumper so as to maintain the temperature of the waste gas from the ball mill to a constant level.

(11) A method according to (10), wherein the total amount of the hot air and the cold air is controlled to a constant level by utilizing t an air-flow meter, each mounted downstream of the boosting fan and the damper.

The present invention is hereinafter described in detail.

The inventive operation method (1) is characterized by blowing hot air into a ball-mill for crushing the flux and drying the flux in the ball mill. The inventive operation method (1) is also characterized by drying only the copper ore in a drier, while the copper ore and the flux are dried is a drier according to the prior art. Another characteristic of the inventive operation method (1) resides in the fact that the flux is pulverized and conveyed directly before the smelting furnace along the first system, while the copper ore in the powder form is dried and conveyed along the second system. The first and second systems are separated from one another.

In the first system, water content of the flux should be decreased to a level as low as possible, since the water vaporizes out of the flux in a smelting furnace and the temperature in the furnace interior decreases due to the latent heat of water. Drying in the first system is, therefore, carried out to preferably attain 0.5% by weight or less of water content by utilizing the heat generated by crushing and hot air whose temperature preferably ranges from 180 to 250° C. Blowing the hot air into a ball mill can prevent dew formation and hence seizure of the crushed materials in the ball mill. Since hot air drying in a ball mill increases the drying amount of flux, the entire amount of the flux can be treated and conveyed in the first system, and the flux is not treated or conveyed in the second system.

The entire amount of the flux required for smelting in the flash furnace is dried in a ball mill according to the present invention. A conventional drier dried approximately 10% of the flux. A drier according to the inventive operation method dries only the copper concentrate, that is, the drying amount of the copper concentrate can be increased by approximately 10%. It is, therefore, possible to increase the charging amount of copper concentrate by approximately 10%. Although the drier may be of a known type as described in Japanese Unexamined Patent Publication (kokai) 2002-172339, the charging amount of copper concentrate is increased. Neither the drier body nor the drier equipment need to be reconstructed at all. If necessary, fuel such as coke can be conveyed, treated and dried in the second system (the method (3), mentioned above). The present invention is hereinafter described with reference to the drawings.

DESCRIPTION OF PREFERRED EMBODIMENTS

Figure 1:
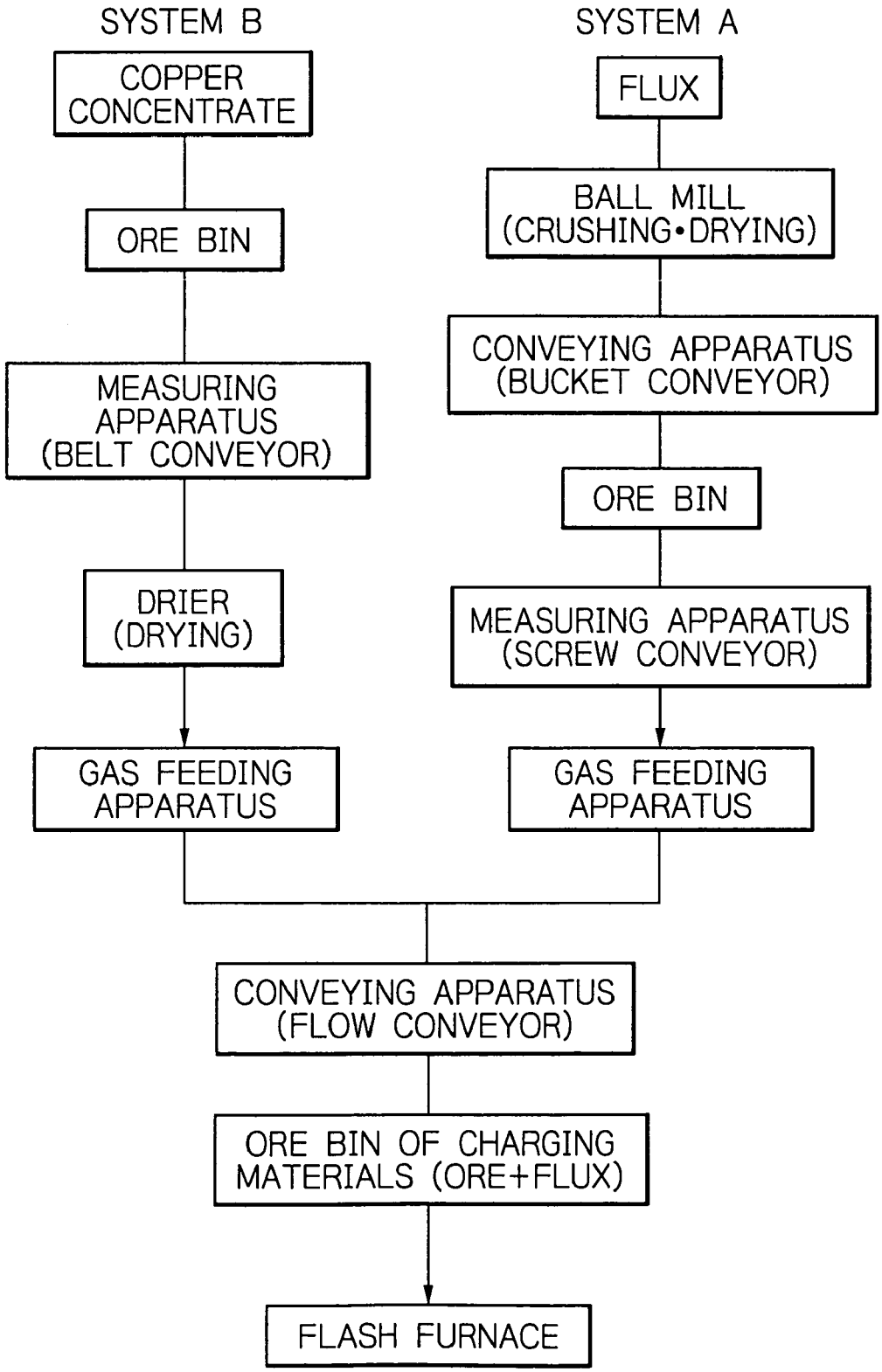
FIG. 1 is a flow sheet illustrating the first and second systems according to the present invention.

The operation method according to the present invention is further described with reference to the flow sheet of FIG. 1. In FIG. 1, the first and second systems are denoted by A and B, respectively.

In the present invention, the copper concentrate and the flux are conveyed through different systems to a location directly before a flash furnace and then charged into the flash furnace. According to the prior art, a predetermined amount of copper concentrate measured and fed from its ore bin and a predetermined amount of the flux measured and fed from its ore bin are conveyed through the same single system, directly before the flash furnace. The flow sheet shown in FIG. 1 corresponds to the operation methods (1) and (2), mentioned above, and are exactly the same as the conveying systems of the present applicant at the present time. In other words, none of reconstruction, modification or change is carried out at all. If necessary, a feeding apparatus of copper ore provided by the present applicant in Japanese Unexamined Patent Publication (kokai) No. 2003-160817 may be employed. In addition, a known ore bin, a measuring apparatus or a pneumatic carrier may be optionally employed and combined in any appropriate sequence in either or both of the two parallel systems as described hereinabove.

Regarding the operation method (3) mentioned hereinabove, the pot of a ball mill for crushing the silica ore is rotated around a rotary axis usually at 10 to −100 rpm. The pot is a cylindrical body having an inner cylindrical wall and surfaces across the rotary axis. An aperture is formed through either or both of the surfaces mentioned above. A chute for charging the silica ore protrudes through the aperture. The other aperture for withdrawing the crushed silica ore is formed through the other surface of the pot. These apertures are symmetrical and are concentric with respect to the rotary axis during the rotation of the ball mill. The chute is positioned so as not to interfere with the walls of the pot during rotation.

According to the operation method (4) mentioned hereinabove, hot air is blown through either aperture into the ball mill during its rotation. The hot air may be blown from either the ore-feeding side or ore-withdrawal side. Preferably, the hot air is blown from the ore-feeding side, since the hot air is brought into contact with silica ore which has just been fed into the ball mill and hence has high water content. The particles of silica ore therefore hardly bond or seize with one another in the ball mill.

Crushing heat of the flux varies depending on the treatment capacity of a ball mill. In the case of a ball mill used in a smelting plant of the applicant, where crushing speed is approximately 20 to 30 tons per hour, the crushing heat corresponds to the calorie, under which the temperature increase of silica ore is a range of 50 to 100° C. The hot air blown according to the present invention elevates the temperature of the crushed material to a level higher than that attained only by crushing heat. The hot air can be blown by various means such as a pipe, a hose and a nozzle. A gap may be formed between the pipe or the like and the aperture. As an example, the following method may be employed.

According to the operation method (5) mentioned hereinabove, a tubular body is mounted to an aperture in such a manner that the pot of a ball mill can rotate around the tubular body. A chute for charging the silica ore protrudes through the tubular body, while hot air is blown by a boosting fan mounted on the tubular body. Since the tubular body is gas-tight and protrudes into a ball mill by utilizing an appropriate seal, the hot air does not leak via the aperture. The drying efficiency can therefore be enhanced. Also, working environment can be maintained clean.

According the operation method (6) of the present invention, a suction fan draws the interior gas of a mill pot is provided on the withdrawal side of crushed ore from a ball mill. Although the hot air may blow the silica ore upward above the chute, the boosting fan can prevent the ore from blowing above. In addition, the hot air can uniformly flow in the mill pot. The suction fan may be located downstream of a dust collector. In this case, since the suction fan draws the gas, from which dust has been already removed, the suction fan is hardly worn out by the dust.

Figure 2:
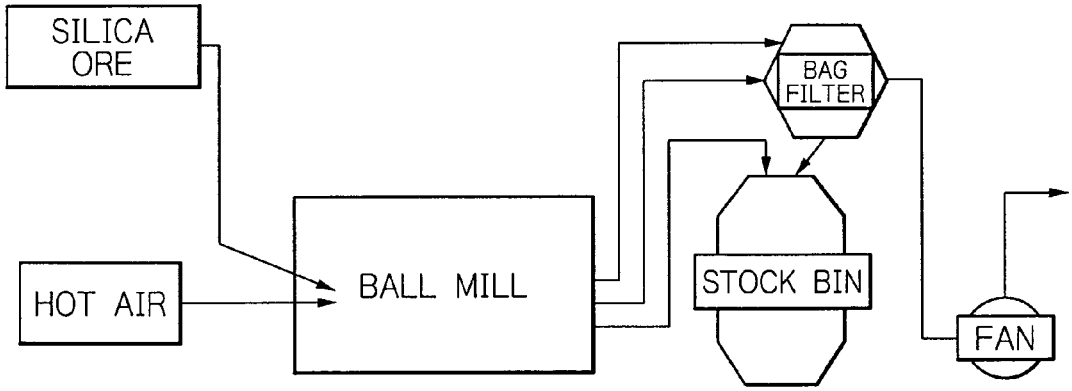
FIG. 2 schematically illustrates a suction method of the interior of a ball mill.

The operation method (7) mentioned hereinabove may be embodied such that a differential pressure gauge (Pg) is provided at the ore-feeding side of a ball mill shown in FIG. 2. Air within the ball mill is drawn through a bag filter by a suction fan such that the pressure in the ore-feeding chute is lower than the ambient pressure, preferably negative pressure of −30 mm aq. A stock bin is a container, in which the pulverized silica ore is temporarily stored.

A preferable heat source is described with reference to the description of Japanese Patent Application No. 2006-093752 (hereinafter referred to as "the prior application") filed by the present applicant on Mar. 31, 2006.

Figure 3:
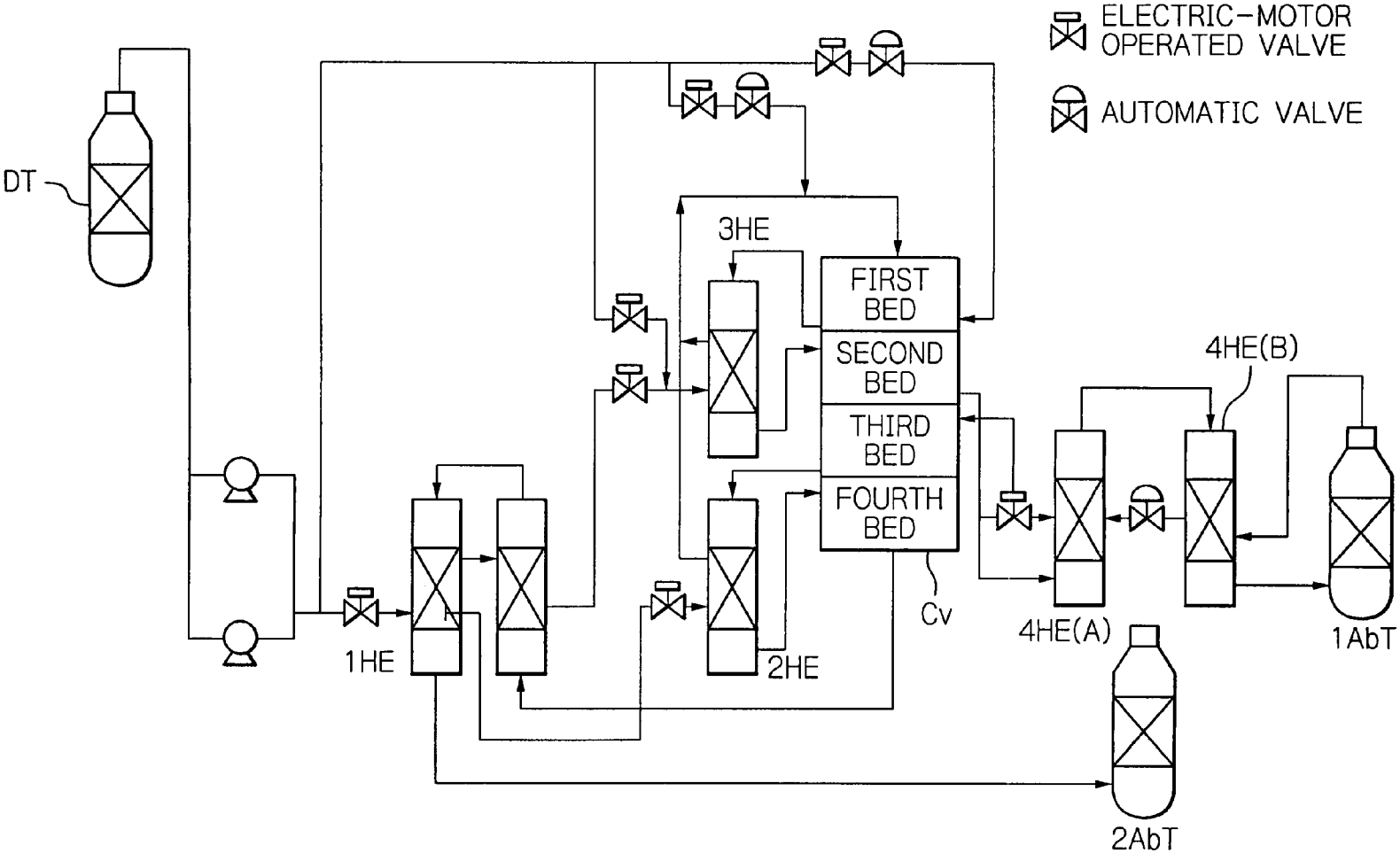
FIG. 3 shows a system of sulfuric acid conversion in the smelting plant of the applicant.

Referring to FIG. 3, a flow sheet of the conventional converter-series in the smelting plant of the present applicant is illustrated.

Generally, a plant of the sulfuric-acid conversion group consists of an $SO_2$ tank (DT), a converter (Cv) for oxidizing a sulfurous acid ($SO_2$) to a sulfuric acid ($SO_3$), a group of heat exchangers (1HE) for heat-exchanging the raw-material gas to reduce its temperature to a predetermined reaction temperature, an absorbing tower (Abt) for absorbing an $SO_3$ gas, and heat-exchangers (2HE, 3HE and 4HE) for controlling the temperature of gases fed from the respective beds of the converter (Cv). In a double-contact type sulfuric acid converter group, the $SO_3$ gas leaving the second bed of the converter (Cv) is conveyed to a high-temperature heat exchanger 4HE(A) and a low-temperature heat exchanger 4HE(3) and is then absorbed by sulfuric acid in an intermediate absorbing tower (Abt). An acid cooler (not shown) is also normally installed to continuously remove heat such as oxidizing heat or dilution heat generated in the absorbing tower under the stationary state. Usually, a heat-exchanger(s) and an acid cooler installed in the system recover heat from gases and continuously eliminate the excessive heat of the gases, whereby the copper production increases. Occasionally, these heat exchanger(s) and the acid cooler may be replaced by an $SO_2$ cooler, an $SO_3$ cooler, an exhaust gas boiler, and an economizer. Such replacement has already been implemented in several smelting plants.

As is known, an $SO_3$ cooler is an effective countermeasure against the reduction of conversion ratio, when the $SO_2$ concentration increases up to 10% or more. An $SO_3$ cooler is usually operated at 160° C. or higher, since the $SO_3$ condenses and clogs a tube at low temperature, any water contained in the $SO_3$ gas forms sulfuric acid, which corrodes the tube walls of the $SO_3$ cooler. Therefore, when an $SO_3$ cooler is to be installed in the converter group shown in FIG. 3, an existing heat exchanger, that is, HE in FIG. 3, is stopped to operate. Such non-operation of the existing apparatus and installation of new apparatus is impractical.

The invention of the prior application proposes to monitor the temperature of conversion gases and to distribute the gas flow appropriately in the parallel systems. As a result, an existing converter system is not fundamentally changed, except that an $SO_3$ cooler is newly installed. Increased production and effective heat recovery can be attained simultaneously. The prior application is related to the contact process for the production of sulfuric acid. $SO_3$, which is converted from $SO_2$, is guided via a heat exchanger to an absorbing tower. The prior application is characterized in that a bypassing gas passage is formed in parallel with a gas passage from the heat-exchanger to the absorbing tower, and a flow-controlling valve and an $SO_3$ cooler are mounted in the bypassing parallel gas passage, and the flow rate of gas is controlled such that the temperature of gas through the $SO_3$ cooler is 160° C. or more. The excessive hot air obtained by the controlling method is utilized for drying the silica ore flux.

A preferred embodiment of the invention of the prior application is hereinafter described with reference to FIG. 4.

Figure 4:
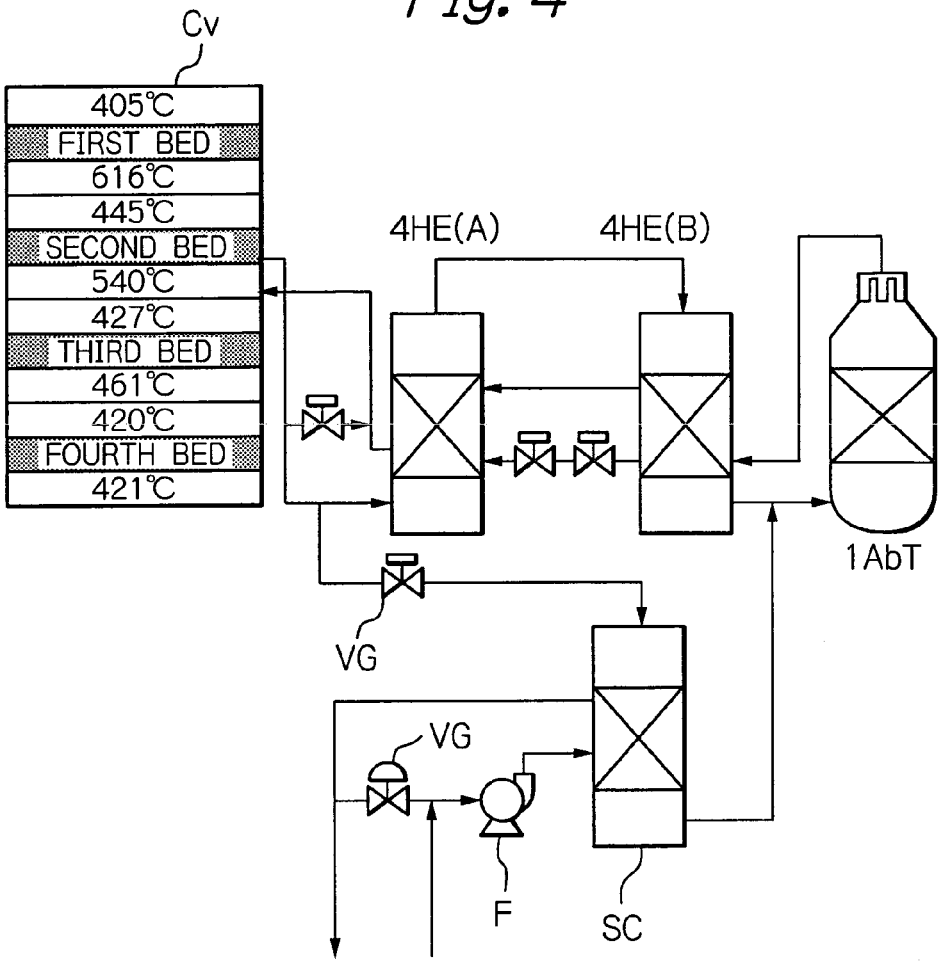
FIG. 4 is an improved system over the system shown in FIG. 3.

In FIG. 4, the converter group shown in FIG. 3 is shown only with reference to the apparatuses after the converter (Cv). One of the most characterizing features of the present embodiment resides in that an $SO_3$ cooler (SC) is installed in a gas passage bypassing the high-temperature heat exchanger 4HE(A) and the low-temperature heat exchanger 4HE(B). A gas-flow control valve (VG) is mounted at the inlet and outlet sides of the $SO_3$ cooler (SC), respectively. The flow rate of the gas through the $SO_3$ cooler can, therefore, be changed freely. A boosting fan (F) is installed to send the ambient air into the $SO_3$ cooler (SC). Since the plant consists of the apparatuses as described above, when the temperature of the conversion gas becomes high, the control valves of gas flow rate (VG) are opened to bypass the $SO_3$ gas. Thus, the conversion rate in the converter (Cv) can be maintained at a high level. In addition, the gas, which is recovered by the $SO_3$ cooler (SC), can be utilized to dry the silica ore in the ball mill. The temperature of the recovered gas is from 280 to 300° C. and the temperature fall of the recovered gas during transferring from the $SO_3$ cooler (Sc) to the ball mill is approximately 70° C.

Since heat is recovered in the $SO_3$ cooler exclusively from clean air, even if any gas somewhat leaks outside a ball mill, pollution of atmospheric air does not occur at all. In addition, a ball mill is additionally provided with a bag filter for removing the dust generated in the ball mill. The gas recovered in the $SO_3$ cooler is free of dust. That is, the dust to be removed by the bag filter is only the one formed in the ball mill. When any one of the control valves for regulating gas flow rate (VG) is closed, the hot air recovered by the heat exchanging in the low-temperature heat exchanger (4HE(B)) is preferably utilized as a heat source for drying the silica ore.

Now, the present invention is described again with reference to preferred embodiments.

According the method (7) mentioned hereinabove, a boosting fan provided in a tubular body urges the hot air into a ball mill. Therefore, the temperature in the ball mill elevates and hence the amount of waste gas discharged from the ball mill increases. A dust collector, such as a bag filter, located in the waste gas side of a ball mill may, therefore, be thermally damaged. As a countermeasure against such thermal damage, ambient air or cold air is blown into a tubular body between the ore-feeding side of a ball mill and a boosting fan of hot air. Temperature of the waste gas can, therefore, be adjusted. Ambient air or cold air may be temporarily blown into the tubular body, only when the temperature of the waste gas measured indicates necessity of blowing cold air.

In the present invention, thermometers may be located at various locations to monitor the crushing process. For example, a thermometer located in an ore-feeding chute can detect the hot air blown above the ore-feeding chute. In addition, a thermometer may be located in the aperture for blowing the hot air to detect clogging of the aperture, because the temperature rises when the aperture is closed by silica ore. Temperature of the waste gas at the exit of a ball mill can also be measured.

Figure 8:
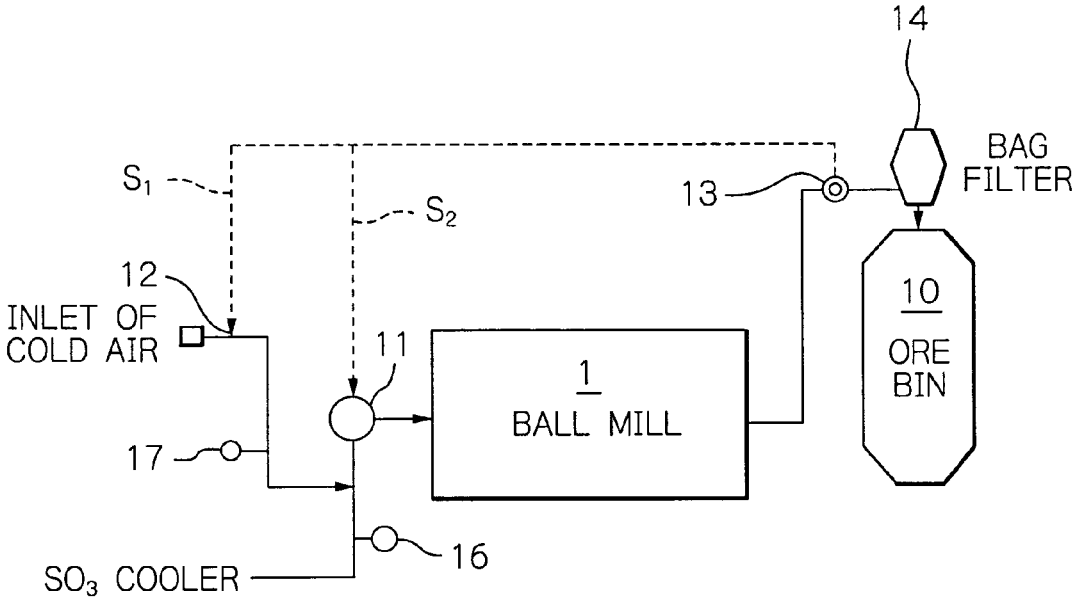
FIG. 8 illustrates a method for controlling the drying in a ball mill.

A preferred embodiment of blowing cold air is described with reference to FIG. 8. FIG. 8 illustrates an apparatus for crushing and drying the silica ore. In FIG. 8, the numeral references denote as follows. 1—a ball mill; 10—an ore bin; 11—a boosting fan for sending the hot air; 13—a thermometer for waste gas; 14—bag filter. These apparatuses are described hereinabove. A passage from the ball mill 1 to the ore bin 10 for conveying the silica ore is omitted.

Cold air is introduced via a damper 12 into a ball mill 1. When the damper 12 is opened and a hot-air boosting fan 11 is operated, the ambient air is introduced into the ball mill 1. The damper 12 may be controlled to either of the two opposite states, that is, complete opening or compete closing. Alternatively, an opening degree of the damper 12 and hence the flow-in rate of ambient air may be continuously controlled between the two opposite states mentioned above. The gas-flow meters 16 and 17 are located upstream and downstream of the boosting fan 11 and the damper 12, respectively.

The temperature of the waste gas leaving a ball mill 1 is measured by a thermometer 13. When the temperature of the waste gas measured by the thermometer 13 is higher (lower) than a target temperature, the damper 12 is opened (closed) by the damper-controlling signal S1. In addition to or instead of the damper control mentioned above, the number of revolutions of a hot-air boosting fan 11 may be increased (decreased), thereby making the temperature of waste gas at a constant level (the method (9) mentioned above).

The controlling method mentioned above can be automatically carried out by utilizing the following empirical equations:

$$\text{Air Flow Rate } Vs = k_1 \cdot R_1 \quad (1)$$

$$\text{Amount of Cold Air Introduced via Damper } V_D = k_2 \cdot D_1 \quad (2)$$

In these equations, $R_1$ indicates the number of revolutions of a motor for driving the fan (rpm). $D_1$ indicates the opening degree of a damper in terms of area ratio with the proviso that 1 and 0 indicate the complete opening and the complete closing, respectively. Letters $k_1$ and $k_2$ indicate constants. The gas flow rates $V_s$ and $V_d$ in $m^3$/hr are measured by the gas-flow meters 16 and 17, respectively.

$$\text{Temperature of Waste Gas } (Tg)=k_3 \cdot V_s - k_4 \cdot V_d \quad (3)$$

The equations (1) and (2) are based on a premise that the amount of silica ore, number of revolutions of a ball mill and the temperature of the waste gas from the ball mill are certain constant values. It is, therefore, necessary that these values are classified into several groups, and further these equations (1), (2) and (3) are empirically determined with regard to each combination of these groups. Then, a control to attain Tg=constant becomes possible. Incidentally, the flow rate of cold air introduced via a damper (Vd) is influenced not only by the opening degree of the damper but also by the number of revolutions of a boosting fan of hot air. It is, therefore, preferable that either the damper or boosting fan is preferentially controlled, and, the temperature of waste gas (Tg) is measured, and subsequently, the other of damper or boosting fan is controlled.

Furthermore, Vs and Vd may satisfy the following relationships.

$$Tg=\text{constant } (C1) \quad (3')$$

$$Vs+Vd=\text{constant } (C2) \quad (4)$$

When these equations (3') and (4) are fulfilled, the temperature of the waste gas and a flow rate of the hot air as well as a crushing speed can be maintained constant during drying. As is known, the output of crushed ore from a ball mill is proportional to the flow rate of air through a ball mill. Any change in air flow rate leads to changes in stagnation amount and time of the ore in a ball mill. This means that the crushing conditions disadvantageously vary. In the present invention, stable crushing is maintained since the equations (3') and (4) are fulfilled and the changes mentioned above do not occur. Hot air is blown at a rate to fulfill these equations. In other words, hot air at a flow rate greater than that fulfilling these equations is not blown. Therefore, the temperature of the waste gas does not rise up to such a level that the cloth material of the dust collector is burnt and damaged. In addition, when there is any hot air in excess of fulfilling these equations, such excessive hot air is introduced into another heat recovering apparatus and the waste gas is effectively utilized.

It is described hereinabove how the excessive heat is recovered by a gas cooler in a bypassing circuit and how the recovered heat is utilized for drying the silica ore. It is, however, needless to mention that other excessive heat recovered in a smelting plant can be utilized to dry the silica ore. In addition, although only the silica ore is mentioned as the flux, lime may also be dried together with the silica ore depending upon the smelting method and raw material conditions of copper ore. Litharge, which is recycling material, can be pulverized and crushed as the other raw material.

The present invention attains the following advantageous effects.

(1) Only the flux is conveyed in the first system, and only the copper ore is conveyed in the second system. According to a prior art, the flux is conveyed into the drier. This part of the flux is completely replaced with the copper ore. Drying amount of the copper ore in the drier can be increased by approximately 10% (methods (1), (2) and (3) mentioned above). Production amount of non ferrous metal can be increased by approximately 10% in the smelting plant as a whole.

(2) The flux is dried in a ball mill under the frictional heat, which is generated under the normal operation of the ball mill. The flux is additionally dried in a forcible manner by hot air. The silica ore therefore hardly adheres in the ball mill and hence the crushing speed is enhanced (the method (4) mentioned above). The method ((4)) can easily cope with the increase in the ratio of flux/ore.

(3) Hot air hardly leaks outside a ball mill and hence the thermal efficiency of drying is enhanced (the method (5), mentioned above).

(4) When leakage of hot air occurs, the pressure within a ball mill can be controlled by creating a pressure difference between the interior and outside of a ball mill by means of operating an exhaust-gas fan. Blowing-up of ore from an ore-feeding belt can, therefore, be suppressed (the method (6), mentioned above). In addition, a hot-air boosting fan can enhance the drying ability and hence the crushing ability (the method (7), mentioned above).

(5) A gas cooler installed in a bypassing passage according to the prior application can recover the hot air with excessive heat. This excessive heat is utilized for drying and crushing. Thermal energy consumption in the entire smelting plant is, therefore, saved (the method (8) mentioned above).

(6) Damage of a dust collector can be prevented. A dust collecting cloth of a bag filter can be protected (the method (9) mentioned above).

(7) In the conventional method for drying in a ball mill, since seizure occurred, drying in a ball mill could not be effectively controlled. According to the present invention, such controlling methods as the methods (10) and (11) are possible. Therefore, recovered heat greater than a requisite amount need not be blown into a ball mill, while excessive heat can be utilized in another recovering apparatus of waste heat. Energy consumption in the entire smelting plant is, therefore, rationally utilized.

The operation method of a smelting plant of the present applicant is hereinafter described with reference to an example and a comparative example.

BEST MODE FOR CARRYING OUT THE INVENTION

A ball mill used for crushing the silica ore in the smelting plant of the present applicant has a diameter of 3.6 m, a length of 10.5 m, and uses 65 ton of balls (21,700 balls) and is rotated at a constant revolution of 16 rpm.

Figure 5:
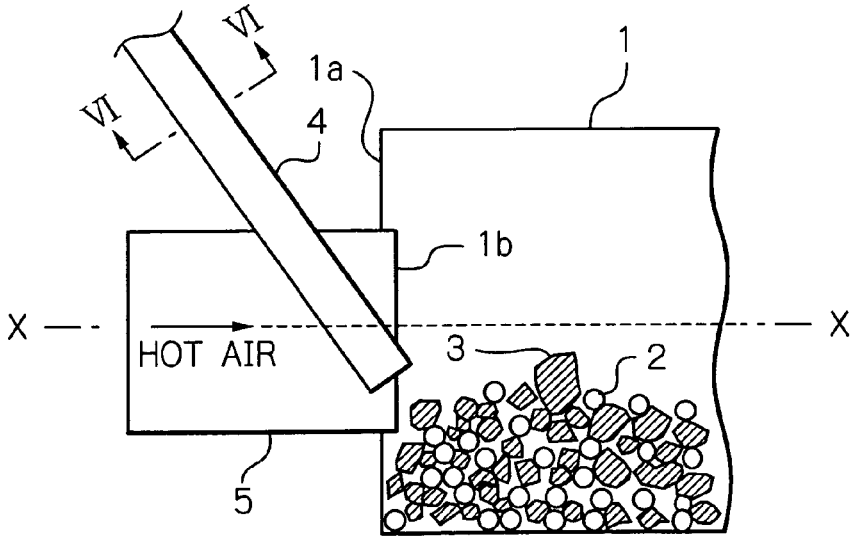
FIG. 5 illustrates a method for feeding ore into a ball mill.

Referring to FIG. 5, which is a partial cross sectional view of a ball mill along the longitudinal axis, the interior of the ball mill at the ore-feeding side is illustrated. The balls 2 are mixed with the granules 3 of silica ore in the mill pot of a ball mill 1. The granules 3 of silica ore are crushed during rotation of a ball mill around the rotary axis X-X. A circular aperture 1*b* is formed on the surface of a mill pot across the rotary axis X-X. The granules of silica ore 3 are charged via the ore chute 4 and through the aperture 1 into the mill pot. The ball mill 1 is aslant downward left side in the drawing. Alternatively, grooves in a spiral form are formed on the inner wall of the mill pot. The materials contained in the mill pot move toward the right side during and along with the rotation.

A tubular body 5 is mounted in the aperture 1*b* rotatably with respect to the ball mill 1. A clearance may be formed between the tubular body 5 and the ball mill 1 but gas leaking via the clearance is prevented by using a sealing means such as a suction fan on the withdrawal side. As a result, a negative pressure is created in the interior of the mill pot.

Figure 6:
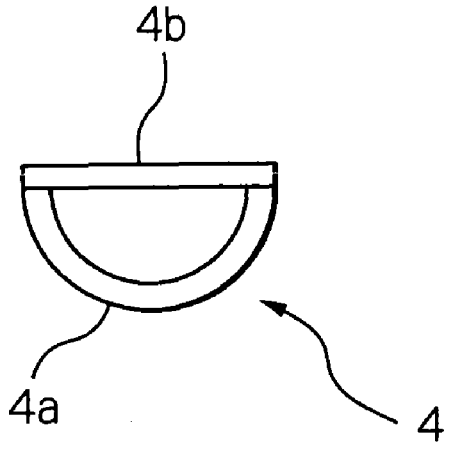
FIG. 6 is a cross sectional view of a chute for charging the ore.
Figure 7:
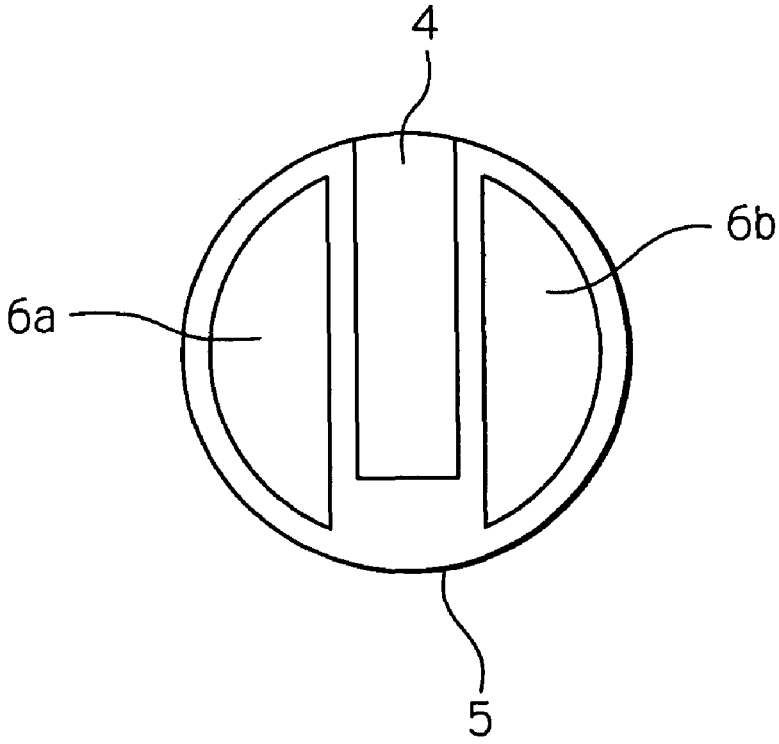
FIG. 7 is a left side view of the tubular body shown in FIG. 4.

As is shown in FIG. 6, an ore chute 4 consists of a semi-circular guide 4*a* and a cover 4*b*. A view of the tubular body 5 as seen from the left side is shown in FIG. 7. Boosting fans 6*a*, 6*b* are mounted in the tubular body 5 so as to urge the hot air into the tubular body 5.

The feed amount of ore is varied within a range not greater than the maxim treatment capacity of 35 t/h. The crushing and drying performances of operation are shown in Table 1.

TABLE 1

| | Ore Feeding Amount (t/h) | Temperature in Pot (° C.) | Flow Rate of Hot Air ($Nm^3$/min) | Temperature at Mill Exit (° C.) | Water Content of Raw Material (%) | Water Content of Crushed Ore (%) | Dried Water Amount (t/h) |
|---|---|---|---|---|---|---|---|
| Comparative CondiTion | 23.8 | 70.3 | 0.0 | 54.7 | 5.55 | 0.22 | 1.27 |
| Condition Of Example 1 | 25.2 | 211.1 | 39.6 | 80.1 | 5.88 | 0.20 | 1.73 |
| Condition Of Example 2 | 33.9 | 235.6 | 70.6 | 76.8 | 4.33 | 0.30 | 1.37 |

The comparative condition in Table 1 is a conventional operational performance attained in a single day, in which hot air is not used. Examples 1 and 2 represent operational results, in which hot air was blown under the conditions given in Table 1. In these results, although the water content of raw material is almost the same as one another, the ore feeding amount of Condition of Examples 1 and 2 is higher than that of Comparative Condition by 1.4 to 10 t/h. This indicates that the crushing speed is increased.

A conventional operational method, in which the flux is conveyed through a drier to a flash furnace, was carried out. An inventive operational method was also carried out, in which the flux is crushed and hot-air dried in a ball mill and is conveyed to a flash mill not via the drier. The operational performances are shown in Table 2.

TABLE 2

| Performance | | Comparative Example | Inventive Example | Difference |
|---|---|---|---|---|
| Total Charging Amount in Flash Furnace | Total Charging Amount (dry-t/h) | 167 | 189 | +22 |
| | Copper-Ore Concentrate (dry-t/h) | 152 | 167 | +15 |
| | Flux (via drier) (dry-t/h) | 15 | 0 | −15 |
| | Flux (not via drier) (dry-t/h) | 0 | 22 | +22 |
| | Ratio of Flux/Copper-Ore Concentrate | 0.099 | 0.132 | +0.037 |
| Grade of Copper Concentrate Charged in Flash Furnace | Cu (%) | 28.87 | 26.45 | — |
| | S (%) | 26.94 | 25.78 | — |
| | Fe (%) | 21.03 | 21.90 | — |
| | $SiO_2$ (%) | 15.05 | 16.60 | — |

As is shown in Table 2, the charging feed amount of copper-ore concentrate increases by approximately 10% according to the inventive example. The inventive example can attain smelting of copper-ore with poor grade.

As is described hereinabove, the production amount of copper can be increased in a flash furnace even if the grade of copper ore is low. In addition, an example of flash furnace smelting is described, the other smelting furnaces such as a reverberatory furnace can be used and attain similar advantageous effects.

The invention claimed is:

1. A method for operating a non-ferrous metal smelting plant, wherein a flux mainly composed of silica ore and a non-ferrous metal-ore raw-material are charged into a smelting furnace via a conveying system, characterized in that said flux is conveyed and treated through a first system, in which the flux is crushed in a ball mill and dried in the ball mill while hot air is blown into the ball mill, and the crushed and dried flux is conveyed directly before the smelting furnace, while the non-ferrous metal-ore raw-material is treated and conveyed via a second system, in which the non-ferrous metal-ore raw material is dried with a drier and then conveyed directly before the smelting furnace, and subsequently the dried flux and the non-ferrous metal-ore raw-material are charged into the smelting furnace, thereby increasing the crushing amount of flux in the first system by means of hot air drying, and limiting the drying in the second system only to the non-ferrous metal ore raw material, and hence increasing the treating amount in the smelting furnace.

2. A method according to claim 1, characterized in that the first system comprises subsequent to the ball mill, an ore bin of the flux and a measuring equipment, and the second system comprises preceding the drier an ore bin of the non-ferrous metal-ore raw-material and a measuring equipment, and further the flux and the non-ferrous metal-ore raw-material are mixed together at a predetermined proportion directly before the smelting furnace.

3. A method according to claim 1, wherein fuel is treated, conveyed and dried in the second system.

4. A method according to claim 1, characterized in that the flux is fed into a lateral-type ball mill from an aperture formed through a wall across the rotary axis of the pot of the ball mill, hot air is blown through the aperture into the pot of the ball mill during rotation of the ball mill, and the crushed and dried flux is withdrawn through an aperture formed through the other wall opposite the feeding aperture.

5. A method according to claim 4, characterized in that a tubular body is mounted in the aperture for blowing the hot air or the aperture for withdrawing the crushed and dried flux in such a manner that the pot of the ball mill rotates about the tubular body, and a chute for feeding the flux protrudes through the tubular body to orient the front end of the chute toward the interior of the pot, and further the hot air is blown through the tubular body.

6. A method according to claim 4, characterized in that the hot air in the pot of the ball mill is drawn by means of a suction fan provided at the ore withdrawal side of the lateral type ball mill.

7. A method according to claim 5, characterized in that a boosting fan mounted on the feeding side of the lateral type ball mill urges the hot air into the pot of a ball mill.

8. A method according to claim 1, wherein the non-ferrous metal smelting plant is operated to produce sulfuric acid through the contact process by means of converting $SO_2$ to $SO_3$ by a converter of the plant for producing sulfuric acid through contact process, and guiding the $SO_3$ via a heat exchanger to an absorbing tower, characterized in that: a bypassing gas passage, which is branched from a gas passage from the heat exchanger to the absorbing tower, is provided in parallel to the latter gas passage; a flow-control valve and an $SO_3$ cooler are mounted on the by passing gas passage; the gas flow through the bypassing passage is controlled to attain temperature of 160° C. or higher in the $SO_3$ cooler; and, the gas recovered in the $SO_3$ cooler recovering gas in the $SO_3$ cooler, is utilized as the hot air for drying the silica ore.

9. A method according to claim 8, characterized in that the boosting fan urges the gas recovered in the $SO_3$ cooler into the ball mill.

10. A method according to claim 9, wherein the boosting fan of hot air is provided with a means for controlling its number of revolutions, and further the bypassing gas passage comprises a controllable damper for introducing cold air into the ball mill, located upstream of the boosting fan, thereby controlling a rotary number of the boosting fan and an opening degree of the dumper so as to maintain the temperature of the waste gas from the ball mill to a constant level.

11. A method according to claim 10, wherein the total amount of the hot air and the cold air is controlled to a constant level by utilizing respective air flow meters, each mounted downstream of the boosting fan and the damper.

* * * * *